US010760176B2

(12) United States Patent
Curran et al.

(10) Patent No.: US 10,760,176 B2
(45) Date of Patent: Sep. 1, 2020

(54) PROCESS FOR REDUCING NICKEL LEACH RATES FOR NICKEL ACETATE SEALED ANODIC OXIDE COATINGS

(71) Applicant: Apple Inc., Cupertino, CA (US)

(72) Inventors: James A. Curran, Morgan Hill, CA (US); Eric W. Hamann, Santa Clara, CA (US); Sean R. Novak, San Jose, CA (US)

(73) Assignee: APPLE INC., Cupertino, CA (US)

( * ) Notice: Subject to any disclaimer, the term of this patent is extended or adjusted under 35 U.S.C. 154(b) by 758 days.

(21) Appl. No.: 14/795,832

(22) Filed: Jul. 9, 2015

(65) Prior Publication Data

US 2017/0009364 A1 Jan. 12, 2017

(51) Int. Cl.
*C25D 11/24* (2006.01)

(52) U.S. Cl.
CPC ..... *C25D 11/24* (2013.01)

(58) Field of Classification Search
CPC ..... B21B 1/46; C25D 11/24
USPC ..... 29/527.2
See application file for complete search history.

(56) References Cited

U.S. PATENT DOCUMENTS 2,888,388 A 5/1959 Stiller
3,016,293 A * 1/1962 Cybriwsky ..... C25D 11/18 148/244
3,388,050 A 6/1968 Eugene
3,411,994 A 11/1968 Eugene
3,715,211 A 2/1973 Quaintance
4,039,355 A 8/1977 Takahashi et al.
4,066,516 A 1/1978 Sato
4,130,466 A 12/1978 Kramer
4,483,751 A 11/1984 Murayama et al.
4,518,468 A 5/1985 Fotland et al.
4,606,796 A 8/1986 Hanazima et al.
(Continued)

FOREIGN PATENT DOCUMENTS

CH 691064 A5 4/2001
CN 1616709 A 5/2005
(Continued)

OTHER PUBLICATIONS

PCT Application No. PCT/US2014/053595—International Search Report & Written Opinion dated Jun. 24, 2015.
(Continued)

*Primary Examiner* — Dah-Wei D. Yuan
*Assistant Examiner* — Andrew J Bowman
(74) *Attorney, Agent, or Firm* — Dorsey & Whitney LLP

(57) ABSTRACT

Sealed anodic coatings that are resistant to leaching of nickel and nickel-containing products and methods for forming the same are described. Methods involve post-sealing thermal processes to remove at least some of the leachable nickel from the sealed anodic coatings. In some embodiments, the post-sealing thermal processes involve immersing the sealed anodic coating within a heated solution so as to promote diffusion of the leachable nickel out of the sealed anodic coatings and into the heated solution. The resultant sealed anodic coating is pre-leached of nickel and is therefore well suited for many consumer product applications. In some embodiments, a post-sealing thermal process is used to further hydrate and seal the sealed anodic coating, thereby repairing structural defects within the sealed anodic coating.

20 Claims, 8 Drawing Sheets

(56) References Cited

U.S. PATENT DOCUMENTS

| | | | | |
|---|---|---|---|---|
| 4,631,112 | A | 12/1986 | Usui et al. | |
| 4,756,771 | A | 7/1988 | Brodalla et al. | |
| 4,856,326 | A | 8/1989 | Tsukamoto | |
| 4,894,127 | A | 1/1990 | Wong et al. | |
| 5,066,368 | A | 11/1991 | Pasqualoni et al. | |
| 5,078,845 | A | 1/1992 | Kunugihara et al. | |
| 5,277,788 | A | 1/1994 | Nitowski et al. | |
| 5,336,341 | A | 8/1994 | Maejima et al. | |
| 5,705,225 | A | 1/1998 | Dornfest et al. | |
| 5,919,561 | A | 7/1999 | Fuchs et al. | |
| 6,027,629 | A | 2/2000 | Hisamoto et al. | |
| 6,339,958 | B1 | 1/2002 | Tsui et al. | |
| 6,581,446 | B1 | 6/2003 | Deneuville et al. | |
| 7,527,872 | B2 | 5/2009 | Steele et al. | |
| 7,732,056 | B2 | 6/2010 | Bhatnagar et al. | |
| 8,691,403 | B2 | 4/2014 | Amakusa et al. | |
| 8,950,465 | B2 | 2/2015 | Lin et al. | |
| 8,962,163 | B2 | 2/2015 | Shimao et al. | |
| 9,359,686 | B1 | 6/2016 | Curran et al. | |
| 9,487,879 | B2 | 11/2016 | Tatebe et al. | |
| 2003/0106201 | A1* | 6/2003 | Holloway | A45D 33/18 29/527.2 |
| 2003/0196907 | A1 | 10/2003 | Viola | |
| 2004/0004003 | A1 | 1/2004 | Hesse | |
| 2005/0061680 | A1 | 3/2005 | Dolan | |
| 2005/0106403 | A1 | 5/2005 | Yui | |
| 2006/0019035 | A1 | 1/2006 | Munz et al. | |
| 2008/0274375 | A1 | 11/2008 | Ng et al. | |
| 2008/0283408 | A1 | 11/2008 | Nishizawa | |
| 2009/0050485 | A1 | 2/2009 | Wada et al. | |
| 2009/0233113 | A1 | 9/2009 | Hisamoto et al. | |
| 2010/0024534 | A1 | 2/2010 | Li et al. | |
| 2010/0264036 | A1 | 10/2010 | Hatanaka et al. | |
| 2010/0326839 | A1 | 12/2010 | Morikawa et al. | |
| 2011/0252874 | A1 | 10/2011 | Patten et al. | |
| 2011/0284383 | A1 | 11/2011 | Cabot et al. | |
| 2011/0297319 | A1 | 12/2011 | Chen et al. | |
| 2012/0298513 | A1 | 11/2012 | Shimao et al. | |
| 2013/0008796 | A1 | 1/2013 | Silverman et al. | |
| 2013/0153427 | A1 | 6/2013 | Tatebe | |
| 2013/0156635 | A1 | 6/2013 | Lee et al. | |
| 2013/0319866 | A1 | 12/2013 | Browning et al. | |
| 2013/0319872 | A1 | 12/2013 | Woodhull et al. | |
| 2014/0083861 | A1 | 3/2014 | Askin et al. | |
| 2015/0090598 | A1 | 4/2015 | Tatebe et al. | |
| 2016/0060783 | A1 | 3/2016 | Curran et al. | |
| 2016/0237586 | A1 | 8/2016 | Curran et al. | |
| 2017/0051425 | A1 | 2/2017 | Curran et al. | |
| 2017/0051426 | A1 | 2/2017 | Curran et al. | |
| 2017/0088917 | A1 | 3/2017 | Curran et al. | |
| 2017/0088968 | A1 | 3/2017 | Curran et al. | |

FOREIGN PATENT DOCUMENTS

| | | | |
|---|---|---|---|
| CN | 1965618 | A | 5/2007 |
| CN | 102333897 | A | 1/2012 |
| CN | 102666894 | A | 9/2012 |
| CN | 103484737 | A | 1/2014 |
| CN | 103484916 | A | 1/2014 |
| CN | 103526088 | A | 1/2014 |
| EP | 2301760 | A2 | 3/2011 |
| JP | 02243794 | A | 9/1990 |
| JP | H0347937 | A | 2/1991 |
| JP | 04210496 | A | 7/1992 |
| JP | 2000313996 | A | 11/2000 |
| JP | 2009209426 | A | 9/2009 |
| KR | 1020120021616 | A | 3/2012 |
| TW | 201522716 | A | 6/2015 |

OTHER PUBLICATIONS

Habazaki et al., "Nanoscale Enrichments of Substrate Elements in the Growth of Thin Oxide Films", Corrosion Science, vol. 39, No. 4, pp. 731-737, 1997.

Vesborg et al., "Addressing the terawatt challenge: scalability in the supply of chemical elements for renewable energy," RSC Advances, 2, pp. 7933-7947, 2012.

U.S. Appl. No. 14/474,021—Non Final Office Action dated Aug. 27, 2015.

PCT Application No. PCT/US2015/010736—International Search Report & Written Opinion dated Nov. 29, 2015.

PCT Application No. PCT/US2015/024349—International Search Report & Written Opinion dated Dec. 17, 2015.

PCT Application No. PCT/US2015/025000—International Search Report and Written Opinion dated Jan. 26, 2016.

Garcia-Vergara, S. et al; "Morphology of enriched alloy layers in an anodized Al—Cu alloy" Applied Surface Science, 205 (2003),p. 121-127.

Alwitt, R.S. and R.C. McClung , "Mechanical Properties of Anodized Aluminum Coatings"; Proceedings of the SUR/FIN7 '92, American Electroplaters and Surface Finishers Society, Atlanta, Georgia, Jun. 1992.

Yann Goueffon et al., "Study of Degradation Mechanisms of Black Anodic Films in Simulated Space Environment" URL: http://webcache.googleusercontent.com/search?q=cache:fsJq5LjVTVIJ:esmat.esa.int/materials_news/isme09/pdf/6-Contamination/S8%2520-%2520Goueffon.pdf+&cd=1&hl=en&ct=clnk&gl=us.

Henkel Corporation "BONDERITE M-ED 9000 Anodizing Seal (Known as Anoseal 9000)" Technical Process Bulletin Issued Jun. 10, 2013.

Ling Hao and B. Rachel Cheng., "Sealing Processes of Anodic Coatings—Past, Present, and Future", Metal Finishing, vol. 98, Issue 12, Dec. 2000, p. 8-18.

European Patent Application No. 16150283.6—European Search Report dated Jun. 9, 2016.

International Patent Application No. PCT/US2016/043256—International Search Report and Written Opinion dated Oct. 12, 2016.

International Patent Application No. PCT/US2016/043384—International Search Report and Written Opinion dated Oct. 12, 2016.

Taiwanese Patent Application No. 105125818—Office Action dated Jul. 6, 2017.

Chinese Application for Invention No. 201610011395.4—First Office Action dated Jul. 21, 2017.

Chinese Patent Application No. 201610011395.4—Second Office Action dated Feb. 14, 2018.

Guo Jialin etc., "Analysis on affecting factors of thermal cracking behavior of anodic oxide film on 6060 aluminum alloy", Materials Research and Application, vol. 5, No. 3, Sep. 2011, p. 229-232.

Habazaki, H. et al. Effects of Alloying Elements in Anodizing of Aluminium. Trans IMF, 1997, 75(1), 18-23. (Year: 1997), 6 pages.

The Aluminum Association, Inc. International Alloy Designations and Chemical Composition Limits for Wrought Aluminum and Wrought Aluminum Alloys. Jan. 2015. (Year: 2015), 38 pages.

Welding Handbook, vol. 5—Materials and Applications, Part 2 (9th Edition), American Welding Socieity, Table 9.1 (2015).

* cited by examiner

PROCESS FOR REDUCING NICKEL LEACH RATES FOR NICKEL ACETATE SEALED ANODIC OXIDE COATINGS

FIELD

This disclosure relates generally to anodizing systems and methods. In particular, methods and systems for providing sealed anodic films that are resistant to leaching of nickel are described.

BACKGROUND

Sealing is an essential aspect of any cosmetic anodizing process for aluminum alloys—necessary to ensure the corrosion resistance of the surface, and to protect the anodic oxide against uptake of dirt and loss of any incorporated coloring agents. Most sealing processes involve exposing the anodic coating to hot aqueous solutions that cause hydration of the pore structure. Although pure boiling water or steam may be used, additives are often added for efficiency and for improved process control and consistency, allowing lower temperatures to be used.

One way to increase the time efficiently of the pore sealing process is to use solutions such as nickel acetate and chromate solutions. For example, nickel acetate sealing solutions can provide exceptionally good sealing and can also be very time efficient, sometimes providing a good seal in a matter of seconds. However, use of these sealing solutions can have some disadvantages. For example, nickel originating from the nickel acetate sealing solution can leach out from the sealed anodic films, which may not be desirable in certain types of products.

SUMMARY

This paper describes various embodiments that relate to anodizing processes and anodic oxide films using the same. The methods described are used to form an anodic oxide film on a metal alloy substrate such that the anodic oxide film is resistant to leaching of any soluble compounds during service, making it better suited to use in wearable devices or devices which are to be in frequent contact with skin.

According to one embodiment, a method of reducing a leach rate of a leachable material from a sealed anodic film is described. The method includes immersing the sealed anodic film in a solution suitable for dissolving an amount of the leachable material so as to provide a diffusion path for removal of an amount of the leachable material such that the sealed anodic film achieves a target leach rate or less. The target leach rate is associated with a predetermined amount of the leachable material leached from the sealed anodic oxide film over a predetermined period of time.

According to another embodiment, a method of treating a sealed anodic film is described. The method includes heating the sealed anodic film in an aqueous solution having a temperature of at least 80 degrees Celsius for at least 20 minutes such that the sealed anodic film has a nickel leach rate of no greater than 0.06 micrograms/square centimeter/week.

According to a further embodiment, a method of treating a sealed anodic film is described. The method includes performing an anodic film modification process on the sealed anodic film. The anodic film modification process forms localized damage in the sealed anodic film. The method also includes exposing the sealed anodic film to a heated aqueous solution having a temperature sufficiently high to repair at least some of the localized damage.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
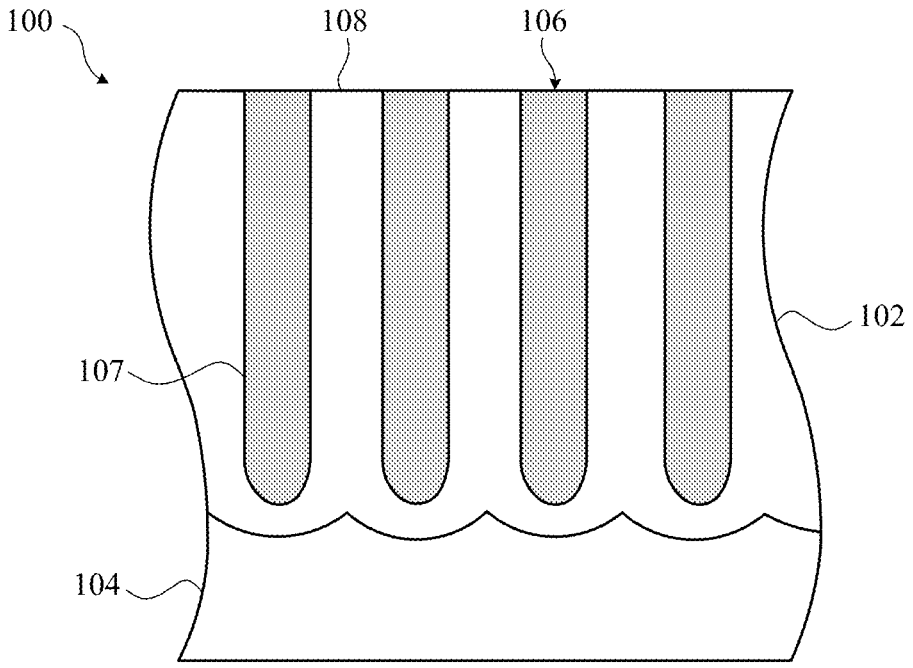
FIGS. 1A-1B show stylized cross section views of a surface portion of a part showing aspects of a nickel acetate anodic film sealing process.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments.

Described herein are processes for providing a sealed anodic film that is resistant to leaching of certain unwanted compounds when exposed to moisture conditions. Examples of such unwanted compounds can include nickel and nickel-containing compounds. Nickel can become incorporated in a sealed anodic film during a sealing process that uses a nickel-containing solution, such as a nickel acetate solution. Some of this nickel can slowly leach from the sealed anodic film when the sealed anodic film is exposed to even relatively low amounts of moisture. This portion of nickel within the sealed anodic film can be referred to as leachable nickel.

Methods described herein involve post-sealing thermal processes that remove at least some of the leachable nickel from sealed anodic films as a means of reducing subsequent in-service nickel leach rates. In some embodiments, the post-sealing thermal process involves exposing a sealed anodic film to a heated solution having a temperature sufficiently high to cause dissolution and diffusion of leachable nickel of leachable nickel away from the sealed anodic film and into the heated solution. By dissolving the soluble forms of nickel under these conditions, the resulting sealed anodic film may be rendered far less prone to leaching nickel and nickel compounds during its service life. In some embodiments, the sealed anodic film is immersed in a bath of the heated solution. In other embodiments, the heated solution is only partially immersed or introduced to the sealed anodic film in vapor form. The heated solution can be an aqueous solution, such as water, or non-aqueous solution that provides sufficient dissolution and diffusion of leachable nickel out of the anodic film.

The heated solution can be heated to a temperature higher than the conventionally recommended exposure limit for sealed anodic films. For example, the process can be performed at solution temperatures of 50 degrees Celsius or more, in some cases 80 degrees Celsius or more. In some embodiments, the sealed anodic films are exposed to solutions at temperatures up to the solution boiling point (e.g., about 100 degrees Celsius for water). These temperatures are generally recommended to be avoided for seal anodic films in air, or even hot air at high relative humidity conditions since it is widely recognized that such temperatures can cause cracking or crazing of the sealed anodic film. However, it was found that by exposing the sealed anodic films to heated solutions under certain conditions—namely hot hydrating conditions—the sealed anodic films experience no significant cracking or crazing damage.

It is further observed that the post-sealing thermal process at higher temperatures may be used to repair some of the minor structural damage that may have been introduced in an intermediate operation, such as laser marking or anodic film surface finishing. The post-sealing thermal process can reduce the corrosion susceptibility of areas where laser marking or surface finishing has been performed.

The methods described herein are not limited the reducing leaching of nickel and nickel-containing compounds. That is, the methods can also be used to remove other types of unwanted constituents within a sealed anodic film. For example, the methods can be used to remove compounds relating to the anodizing process (such as sulfate or other anions incorporated during anodizing), to coloring processes (such as dyes, or pigments), or to other sealing solutions (such as other metal acetates, or chromates).

The present paper makes specific reference to aluminum oxide films formed from aluminum and aluminum alloy substrates. It should be understood, however, that the methods described herein can be applicable to the treatment of any of a number of other suitable metal oxide films, such as those formed from anodizable metals and metal alloys (e.g., containing titanium, zinc, magnesium, niobium, zirconium, hafnium and tantalum). As used herein, the terms anodic film, anodic layer, and anodic coating, oxide film, oxide layer, oxide coating can be used interchangeably and can refer to any suitable metal oxide material, unless otherwise specified.

Methods described herein are well suited for providing durable, chemically clean, and cosmetically appealing surface finishes to consumer products, particularly where frequent, direct skin contact is expected. For example, the methods described herein can be used to form durable and cosmetically appealing finishes for housing or enclosures for computers, portable electronic devices, wearable electronic devices, and electronic device accessories, such as those manufactured by Apple Inc., based in Cupertino, Calif.

These and other embodiments are discussed below with reference to. 1A-8. However, those skilled in the art will readily appreciate that the detailed description given herein with respect to these Figures is for explanatory purposes only and should not be construed as limiting.

Figure 1B:
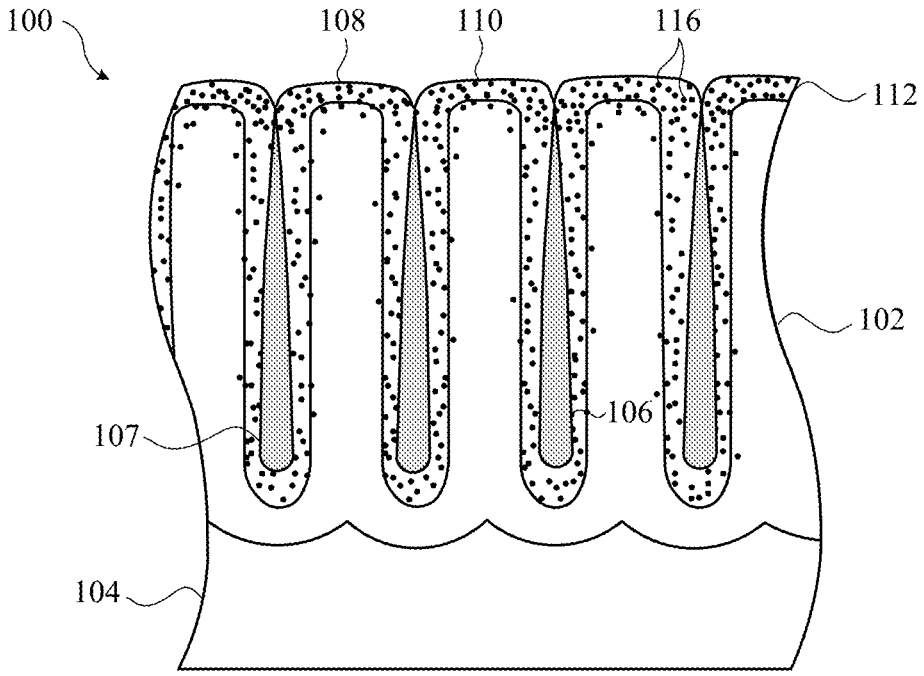

FIGS. 1A-1B show stylized schematic cross-section views of a surface portion of part 100 showing aspects of nickel acetate anodic film sealing processes. Substrate 104 can be made of any suitable anodizable material, such as aluminum and aluminum alloy. FIG. 1A shows part 100 after an anodizing process, wherein a portion of substrate 104 is converted to a corresponding metal oxide or anodic film 102. The anodizing process forms anodic pores 106 within anodic film 102, which have openings at exposed surface 108 of anodic film 102. Anodic pores 106 generally have an average diameter in the nanometers (e.g., 10-150 nm). In some case, anodic pores 106 are utilized to hold colorant 107 (e.g., dye or pigment) that can give part 100 a desired color. Again, this is shown schematically as a reservoir of colorant, uniformly filling the pore, though it is noted that actual colorants may vary significantly in their distributions—from organic dyes, adhered to the walls in just the outermost microns, though inorganic pigments, distributes throughout pores, to metals deposited near the bases of the pores. Anodic pores 106, however, can also be avenues for corrosion of underlying substrate 104. In addition, any colorant 107 that resides within anodic pores 106 can leach out of anodic film 102 via the openings of anodic pores 106 at exposed surface 108. Furthermore, dirt and grime can collect within anodic pores 106, which can dirty the look of anodic film 102.

One common technique to address these issues is implementation of an anodic pore sealing process. FIG. 1B shows part 100 after such a sealing process. Sealing generally involves hydrating the metal oxide material of anodic film 102 into a corresponding hydrated metal oxide material 110, thereby sealing anodic pores 106. In effect, the pore walls between anodic pores 106 swell such that the openings of anodic pores 106 at exposed surface 108 close off. Barrier 112 at the outermost region of anodic film 102 proximate to exposed surface 108 can also be formed. In this way, colorant 107 within anodic pores 106 is sealed within closed off anodic pores 106. Since anodic pores 106 are sealed, dirt, grime and corrosion promoting materials are also prevented from entering anodic pores 106.

Examples of hydrothermal sealing processes include exposing anodic film 102 to a boiling aqueous solution (e.g., 98±2 degrees Celsius) or steam, sufficient to form hydrated metal oxide material 110. For example, if anodic film 102 includes aluminum oxide ($Al_2O_3$), hydrated metal oxide material 110 can include boehmite AlO(OH) and/or gibbsite ($Al(OH)_3$). This hydrothermal sealing mechanism is most efficient at relatively high solution temperatures, such as within a few degrees of boiling water. The predominant reaction—hydration to boehmite AlO(OH)—typically occurs at temperatures over 80 degrees Celsius. At lower temperatures, the dominant hydration product can be gibbsite ($Al(OH)_3$) and the process is far less efficient.

In some cases, the sealing solution includes additives, such as nickel acetate or chromate, to increase the efficiency of the sealing process. These additives may change the reaction chemistry. In the case of chromates, for instance, aluminum oxidichromate or aluminum oxichromate may be formed in preference over boehmite. Nickel acetate may catalyst or accelerate the hydrothermal sealing mechanism, but it is also believed that nickel hydroxide ($Ni(OH)_2$) may be co-precipitated with the boehmite formation. A typical nickel acetate based sealing chemistry comprises about 1.4-1.8 g/L of nickel, and is operated at pH of 5.5-6.0 and a temperature of 85-90 Celsius—significantly lower than the temperatures required for efficient hydrothermal sealing in pure water (or steam). The high efficiency of a hot nickel acetate seal also results in a more wear-resistant oxide film (as assessed by Taber abrasion) than a hot water sealed film.

Nickel acetate based sealing chemistry provides exceptionally good sealing and is also very time efficient in terms of exposure times. For example, nickel acetate sealing can provide an effective barrier 112 in a matter of seconds. Typically, about 1-2 minutes of sealing are recommended per micrometer of coating thickness, such that a 15 minute nickel acetate sealing operation typically provides sufficient sealing of an aluminum oxide anodic film 102 to resist most everyday corrosive environments. It is notable that in a nickel acetate based sealing operation, the openings of the pores are typically plugged within a minute of immersion. This minimizes the leaching of colorants such as organic dyes, and is thus desirable in maintaining precise color control.

Nickel acetate sealing always incorporates nickel 116 into the anodic film 102, particularly in hydrated metal oxide material 110 near exposed surface 108. In some aluminum oxide anodic films 102, nickel 116 is incorporated to about 1-3 weight percent (as evaluated in 20 kV surface Energy Dispersive Spectroscopy). Nickel 116 is, for the most part, fixed into the microstructure of hydrated metal oxide material 110 (e.g., boehmite) and is likely in the form of a mixture of hydroxide and acetates. However, the nickel 116 may be in other forms, such as in ionic form or in other compound form. Some of this incorporated nickel 116 can be susceptible to slow leaching under certain conditions. For example, some of nickel 116 can leach from anodic film 102 when exposed to certain conditions—notably moisture or humidity, and especially at low pH—conditions which might be encountered in contact with a user's skin. This can cause some problems in cases where anodic film 102 is in contact with skin since nickel 116 at some levels can cause irritation in certain, sensitized individuals. An allergic response to nickel is a common cause of contact dermatitis. Standards exist for the acceptable levels of leachable nickel for objects in skin contact, based on test methods such as EN 1811, where the object is placed in an artificial sweat solution for a week and the concentration of nickel leached into the solution is quantified. Although a typical nickel acetate sealed anodic oxide would meet most standards, it is still desirable to further reduce nickel leach rates, to further reduce the likelihood of any allergic responses among users.

It is a goal in embodiments described herein to reduce the amount of leachable nickel within anodic film 102 to a predetermined acceptable level. Leachable nickel can refer to that portion of incorporated nickel 116 that most readily leaches from anodic film 102 under certain conditions. The remaining portion of nickel 116 that remains within anodic film 102 when these certain conditions are applied can be referred to as non-leachable nickel. It is not fully understood why some portions of nickel 116 are more leachable than others. For example, the microstructure of anodic film 102 may influence the leachability of nickel 116 in certain regions of anodic film 102. Additionally or alternatively, certain types of chemical interactions such as bonding of nickel 116 in certain regions of anodic film 102 can influence the leachability of nickel 116. Without intending to be bound by theory, it is believed that most of the leachable nickel resides mainly near exposed surface 108.

Figure 2:
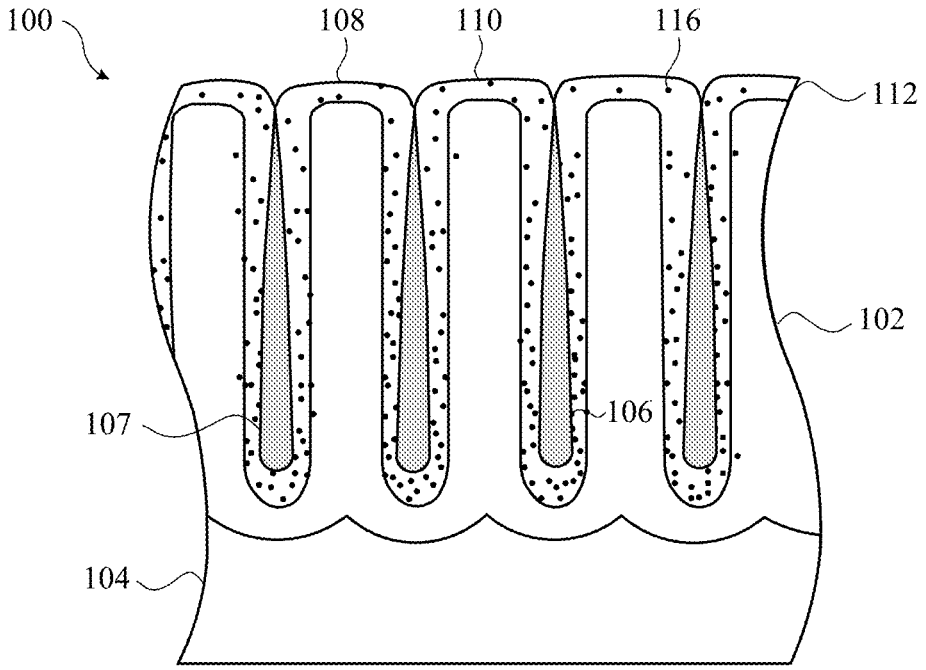
FIG. 2 shows a stylized cross section view the part in FIGS. 1A-1B after undergoing a post-sealing thermal process to remove at least some of the leachable nickel.

The methods described herein involve removing at least a portion of the leachable nickel within anodic film 102, which can be achieved by exposing anodic film 102 to a post-sealing thermal process. FIG. 2 shows part 100 after undergoing a post-sealing thermal process where at least some of the leachable nickel has been removed. As shown, the amount of nickel 116 within anodic film 102 has been significantly reduced. As described above, the mechanism through which leachable nickel leaches from anodic film 102 and the location in anodic film 102 where the leachable portion of nickel 116 resides is not fully understood. As described above, the leachable nickel is believed to mainly reside near exposed surface 108. Therefore, FIG. 2 shows most of the reduction of nickel 116 at or near exposed surface 108. However, some of the leachable nickel may also reside further deep within anodic film 102.

The post-sealing thermal process can involve exposing anodic film 102 to a heated solution such that at least some of the leachable nickel is dissolved and diffused out of anodic film 102 and into the heated solution. In this way, the leaching of the leachable nickel that would normally occur during normal use of part 100 is previously performed in an accelerated manner, resulting in part 100 be pre-leached of most, if not all, of leachable nickel. In some embodiments, the solution is an aqueous solution, while in other embodiments a non-aqueous solution is used. The solution, however, should be suitable for dissolving the leachable nickel and for providing a pathway for diffusion out of anodic film 102. Since the sealing process has already been performed and anodic pores 106 have already been sealed, this post-sealing thermal dissolution process does not generally require the same high level of solution purity required in a sealing process, nor does it require the same high temperatures or degree of temperature control. It may thus be overflowed and replenished more frequently at lower cost than a conventional hot water seal, or alternatively, it may be replenished less frequently if cost or environmental constraints require this. For example, tap water may be used in some cases. It is nevertheless preferably to use higher purity water to minimize corrosion of certain aluminum alloys, and to use higher temperature for efficiency of the process. In some embodiments, the solution is a deionized water solution. Additives to promote the dissolution of specific leachable materials may also be included in the post-sealing thermal solution, preferably selected so as not to induce any significant damage to the bulk aluminum oxide of anodic film 102. Examples include dilute acid (e.g., 2% nitric acid), hydrogen peroxide, or ammonia solutions to help dissolve soluble nickel compounds.

The temperature and time period of the post-sealing thermal solution can vary depending on a desired amount of leachable nickel removal and time constraints for performing the post-sealing thermal operation. In general, the higher the post-sealing solution temperature, the more leachable nickel removed and the quicker the removal. In addition, the longer the post-sealing thermal process, the more leachable nickel that is removed. However, production and manufacturing requirements can place time constraints on the post-sealing operation whilst the cost and practical difficulties of maintaining the process increase significantly as the temperature approaches its boiling point. Therefore, a balance must be determined based on the pressing constraints for a given production process. In particular embodiments, the temperature ranges between about 80 and 90 degrees Celsius. However, lower or higher temperatures can be used. It is of particular note that temperatures as low as 50 to 70 degrees Celsius have been shown to provide removal of some of the leachable nickel, and that there is no abrupt change in the process efficiency at 80 Celsius, indicating that the mechanism is independent of that of hydrothermal sealing processes. Use of these lower temperatures, however, will generally take longer and therefore may not be preferable in certain situations where the speed of the post-sealing thermal process is important.

In some embodiments, the temperature of the post-sealing solution is high enough to further hydrate and seal anodic film 102, thereby enhancing the previously performed nickel acetate sealing process (FIG. 1B). For example, temperatures of 80 degrees Celsius and higher may be sufficiently high to further hydrate anodic film 102. In some embodiments, the solution temperature is within 5 degrees Celsius of the boiling point of the solution. For example, a water solution can be heated to 100±5 degrees Celsius. These higher temperatures can be used to repair damage, such as small cracks, that can be formed within sealed anodic film 102 during one or more optional post-sealing operations. Details of this repairing function are described further below.

As noted above, heating to or beyond a threshold temperature for hydrothermal sealing is not a requirement, however, for removal of leachable nickel. For example, hydration of alumina to boehmite proceeds at temperatures of about 80 degrees Celsius or more. Because the thermal process for effective dissolution of nickel can occur above and below this temperature threshold with similar efficiency, it may be surmised that this process operates independently from the mechanism of hydrothermal sealing. Thus, temperatures of less than 80 degree C. can result in efficient nickel dissolution. For example, temperatures of about 70 degrees Celsius and lower may not be high enough to provide further sealing, but still may be sufficiently high to efficiently remove a desired amount of leachable nickel.

A particular embodiment, however, relies on operating within the temperature range of efficient hydrothermal sealing. As such, when the nickel leaching process is itself contributing to the final seal, it is possible to significantly reduce the duration of the initial nickel seal. For instance, a mere 30 second nickel seal may be used—well below the 1-2 minutes per micrometer anodic film thickness conventionally recommended for such a seal. A very brief nickel acetate seal such as this serves primarily to block the pore openings, and limit leaching of colorants during subsequent sealing. This reduced nickel acetate exposure time in itself reduces the amount of nickel incorporated into the anodic oxide, lowering the level of leachable nickel, and further lowering the final level of leachable nickel after the subsequent post-sealing thermal process. By compensating for the reduce nickel acetate sealing duration with hydrothermal sealing during the nickel leaching process, the same final seal integrity (as measured by admittance testing or acid dissolution testing) may be achieved.

The post-sealing thermal process does not generally negatively affect retention of colorant 107 within anodic pores 106 since anodic pores 106 have already been sealed. In embodiments where the temperature of the post-sealing thermal process is high enough to promote further hydrothermal sealing, the further sealing may even correct for any incomplete sealing of anodic pores 106 during the sealing process (FIG. 1B), thereby facilitating retention of colorant 107 in service. Moreover, some colorants (e.g., metallorganic dyes including heavy metals, heavy-metal base pigments, or metals deposited in pores 106) may themselves present undesirable leach levels in service, and in a further embodiment, the leaching of leachable colorants may itself be the objective of the post-seal thermal treatment. It should be noted, however, that the embodiments described herein are not limited to colored anodic films. That is, anodic films without colorants can also benefit from the nickel removal processes described herein.

The amount of leachable nickel that is removed from anodic film 102 may not be easily measured using bulk material analyses that measure a total amount of nickel 116 content within anodic film 102. For example, inspection using a scanning electron microscope (SEM) may not be able to detect a reduction of apparent nickel 116 content within anodic coating 102 after the post-sealing thermal process is complete. This may be because the leachable nickel may only be a small percentage of the total amount of nickel 116 within anodic film. Therefore, other methods, such as measuring a nickel leach rate under predetermined conditions can be used to determine the amount of leachable nickel remaining within anodic film 102 after the post-sealing thermal process. The previously mentioned EN 1811 is a notable example of a test method widely applied to evaluate nickel leach rates from objects.

It should be noted that the post-sealing thermal process could additionally or alternatively be used to remove other leachable materials other than nickel from anodic film 102. These other leachable materials could have been incorporated into anodic film 102 during a sealing process, during an anodizing process and/or during an anodic film coloring process. For example, metal acetates and/or chromates could have been incorporated within anodic film 102 during a sealing process. Sulfates and/or other anions could have been incorporated within anodic film 102 during an anodizing process. Furthermore, metal-organic dye compounds and/or metal-based pigments (e.g., heavy metal-based pigments).

Figure 3:
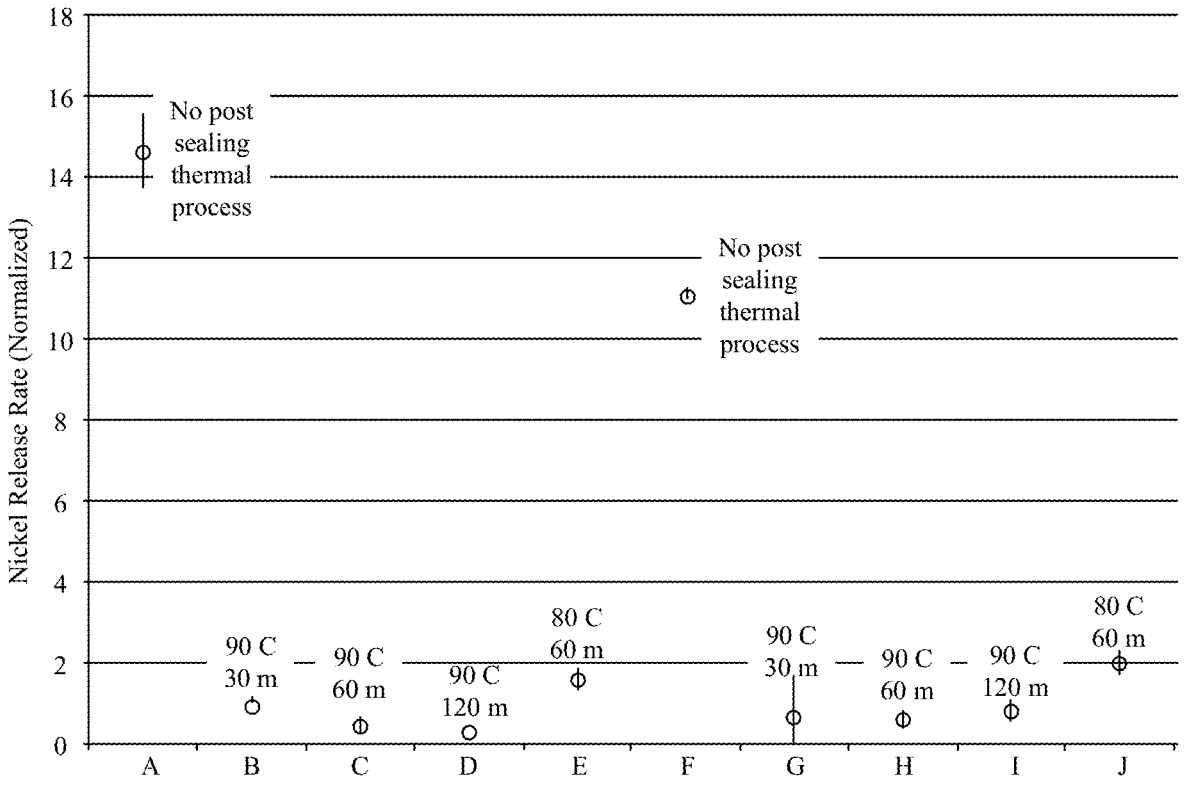
FIG. 3 shows a graph indicating leach rate results of anodic film samples that have undergone different post-sealing thermal treatments.

FIG. 3 shows a graph indicating leach rate results of sealed anodic film samples A-J that have undergone different post-sealing thermal treatments. The graph of FIG. 3 shows normalized amounts of nickel released from samples A-J under the same testing conditions. The nickel release rate is obtained by immersing the sealed anodic samples, of a known surface area, within an aqueous solution (most typically, an artificial sweat solution of a certain composition and pH, representative of a relevant population, is used) at a certain temperature (e.g., room temperature), for a certain period of time (e.g., one week) and measuring the amount (e.g., a nickel ion concentration within a given volume of the solution—as measured by a technique such as atomic absorption spectroscopy or inductively coupled plasma-mass spectroscopy) of nickel that is released in the aqueous solution. The amount of nickel within the water solution can be measured using, for example, liquid chromatography mass spectrometry. The relative amount of nickel released can be calculated as amount of nickel released per area (e.g., $cm^2$) of the anodic film. In some embodiments, the amounts of nickel release rates are measured in the order of micrograms or nanograms.

All samples A-J have undergone the same, conventional, nickel acetate based sealing process (i.e.,20 minutes for a 10 micrometer thickness of anodic oxide). Samples A and F have not undergone any post-sealing thermal process, and samples B-E and G-J have undergone post-sealing thermal processes in water. Samples F-J have anodic pores infused with dye and samples A-E have no in pore-fused dye. Samples B and G have undergone a 90 degree C. post-sealing thermal process for 30 minutes. Samples C and H have undergone a 90 degree C. post-sealing thermal process for 60 minutes. Samples D and I have undergone a 90 degree C. post-sealing thermal process for 120 minutes. Samples E and J have undergone an 80 degree C. post-sealing thermal process for 60 minutes.

As shown, samples B-E and G-J, which have undergone post-sealing thermal processes, released significantly lower amounts of nickel compared to samples A and F, which have not undergone post-sealing thermal processes. In some cases, the nickel release rate was reduced by 1 or 2 orders of magnitude. The graph of FIG. 3 indicates that higher post-sealing solution temperatures and longer post-sealing times result in more removal of leachable nickel. The temperature and exposure time for the post-sealing thermal process can be chosen based on a desired outcome, in particular, an anodic film having a predetermined target nickel leach rate or below. In some embodiments, the target nickel leach rate is about 0.06 micrograms nickel/cm2/week, or less. In some embodiments, the target nickel each rate is about 0.03 micrograms nickel/cm2/week, or less. In some embodiments, the target nickel each rate is about 0.02 micrograms nickel/cm2/week, or less. In some embodiments, the target nickel each rate is about 0.01 micrograms nickel/cm2/week, or less. In some embodiments, a post-sealing thermal process using a 90 degree C. solution temperature for 30 minutes (samples B and G) is sufficient to accomplish a target nickel leach rate. In some embodiments, a post-sealing thermal process using an 80 degree C. solution temperature at least 20 minutes is used to accomplish a target nickel leach rate. In some embodiments, a post-sealing thermal process using a 95 degree C. solution, or higher, for about 100 minutes is used to accomplish a target nickel leach rate as well as provide further hydrothermal sealing.

Although FIG. 3 shows nickel leach rates for anodic samples that have undergone hot water post-sealing thermal process for 30 minutes and higher using temperatures of 80 degrees or higher, lesser time periods and/or lower temperatures can be used. As described above, the hot water solutions can be as low as 50-70 degrees Celsius. In addition, effective post-sealing nickel removal can occur in time periods of 20 minutes or less, depending on the temperatures. In some embodiments, effective leachable nickel removal occurred using a temperature of at least 80 degrees Celsius for 20 minutes or more.

It should be noted that immersing a sealed anodic film to temperatures around or above the sealing temperature (e.g., around 80-100 degrees C.), as described herein, goes against conventional practice and recommendations. Although a warm water rinse after sealing is sometimes recommended to reduce smut residues or facilitate a drying process, the water temperature and amount/length of exposure is limited. For instance, Henkel's Bonderite (see Henkel Technical Process Bulletin, Bonderite M-ED 9000 Anodizing Seal, Issued Jun. 10, 2013) seal's technical process bulletin recommends a warm deionized water rinse be used after sealing to facilitate drying, specifying a temperature of 110-140 degrees F. (43-60 degrees C.). One reason that such an operation might not have been considered is that in general, well sealed anodized films have been observed to crack or craze when exposed to temperatures of 80 Celsius or more in vacuum, in air, or even in humid conditions (steam)—with the precise limit depending to some degree on the temperature of the initial sealing operation, and on the conditions of the subsequent heating (such as in the relative humidity of the air). The cracking is due to differential thermal expansion between the substrate and the anodic film. For example, aluminum substrates can have a coefficient of thermal expansion that are about five times greater than that of its corresponding anodic film. In the embodiments described herein, however, it is noted that exposure of previously sealed anodic films to hot aqueous solutions—even at boiling point—can result in substantially no cracking or physical/mechanical damage to the anodic film.

It should be noted that the thermal dissolution methods described herein are not limited to removing nickel. That is, the methods described herein can be exploited for the dissolution of any undesirable soluble components of a sealed anodic film. Examples include compounds incorporated from other seal chemistries (e.g., chromates, or other heavy metals or organic compounds), colorants, and also compounds incorporated from anodizing processes. It may also be exploited as a secondary reparatory hydrothermal sealing operation to repair localized damage, which a sealed anodic film might have experienced by such operations as laser marking. Similarly, anodic films that have been sealed and are then subjected to a surface finishing operation (e.g., lapping, buffing and/or polishing) may have had the integrity of their original seal compromised, and benefit from subsequent exposure to the post-sealing thermal processes described herein. The post-sealing thermal process may also help remove hot-water-soluble polishing or buffing compounds, which could otherwise cause discoloration and present a corrosion risk in the anodic coating.

It is further noted that the sealing and chemical resistance of an anodic film is not substantially degraded by the treatments described herein. The dissolution occurs on a physical or chemical scale that has no detrimental effect on anodic film microstructure. Surface plugging (as evaluated by dye uptake tests or the ability to immediately wipe off permanent marker with a wet paper towel) is maintained at the high level achieved by a preceding nickel acetate seal. Admittance tests show no increase in admittance and may even show an improvement if the hot water process is conducted at temperatures of over 80 Celsius (such that further hydrothermal may take place). It may thus be surmised that the soluble components of the anodic film, which are removed by the post-sealing thermal process, either plays no positive role in the original seal quality, or that their sealing function is readily replaced by hydration of any damaged sites in the anodic film.

Figure 4:
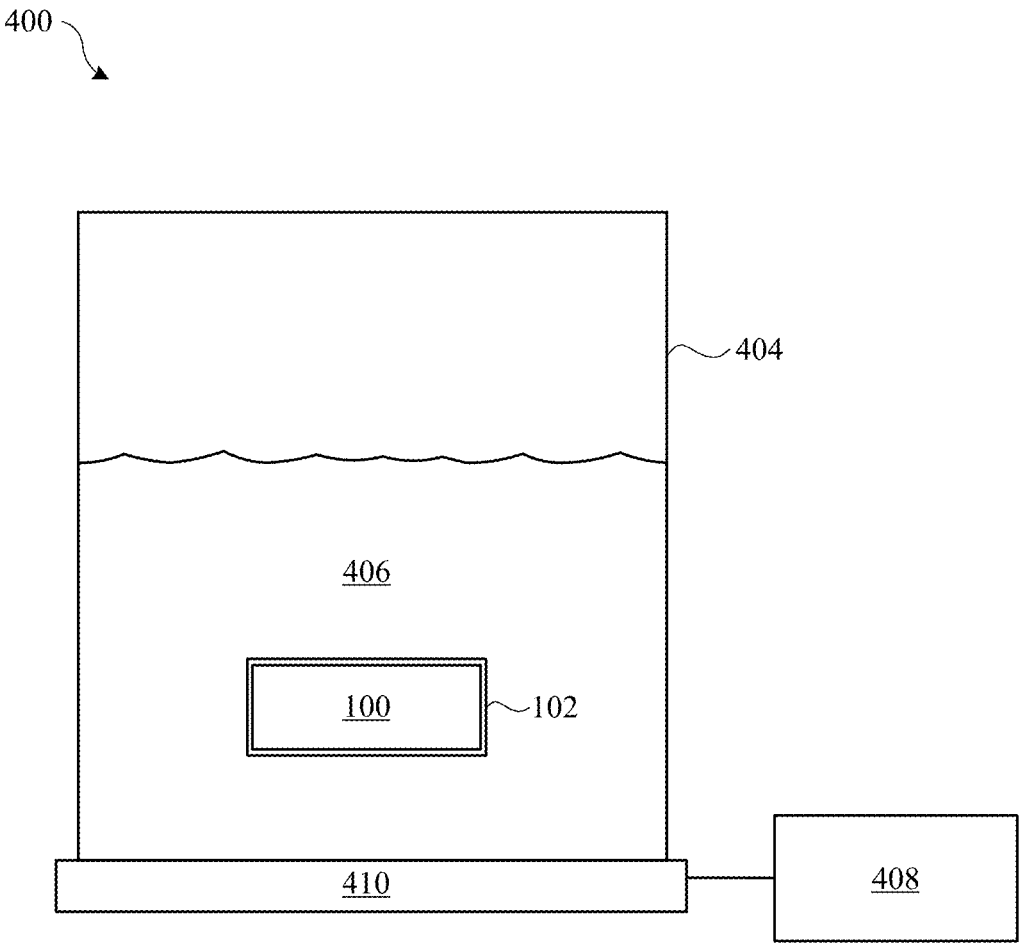
FIG. 4 shows a schematic view of a system suitable for exposing a part to a post-sealing thermal process.

FIG. 4 shows a schematic view of system 400 suitable for exposing part 100 to a post-sealing thermal process, in accordance with some embodiments. System 400 includes tank 404 suitable for containing solution 406 and part 100. Heater 410 can be configured to heat solution 406 to a predetermined temperature as controlled by controller 408. Tank 404 can include a temperature sensor, such as a thermocouple, that can monitor the temperature of solution 406 a post-sealing thermal process. In some embodiments, a stirring mechanism is used to stir solution 406.

During the post-sealing thermal process, part 100 is immersed within solution 406, which is heated to a temperature sufficiently high to induce dissolution and diffusion of at least some of the leachable nickel away from sealed anodic film 102 of part 100. The leachable nickel can be in the form of nickel atoms/ions and/or nickel-containing compounds, such as nickel hydroxides or nickel acetates. Solution 406 can be any solution suitable for inducing dissolution and providing a diffusion path for leachable nickel within anodic film 102. In some embodiments, solution 406 is an aqueous solution. In a particular embodiment, solution 406 is water, such as deionized water. In some embodiments, where the local water quality permits, and the substrate is sufficiently corrosion resistant, the water may even be tap water, since the purity constraints of a typical sealing process do not apply.

As described above, the temperature of solution 406 can vary depending on a desired amount of removal of leachable nickel and process time constrains. In some embodiments, the composition and thickness of anodic film 102 may also factor in determining temperature and exposure time. The temperature and exposure time can be chosen to attain a predetermined nickel leach rate, which can be determined by nickel leach rate methods, such as described above with reference to FIG. 3. It should be noted that due to sample-to-sample variation, many samples should be evaluated to assess a given process configuration, and a substantial margin of error should be allowed for. In some embodiments, the predetermined nickel leach rate is no greater than 0.06 micrograms/square centimeter/week. In some embodiments, the temperature of solution 406 is chosen to be high enough cause further hydration of anodic film 102, thereby repairing possible damage within anodic film 102 caused by other manufacturing processes such as laser marking or surface finishing. In particular embodiments, the temperature of solution 406 is held at a temperature of about 80 degrees Celsius or higher for a time period of at least 20 minutes. In further particular embodiments where solution 406 promotes efficient hydrothermal sealing, it may be used to compensate for a shorter initial sealing time. A nickel acetate process of less than one minute may be used, serving only to plug the openings of pores 106 and fix colorant 107. This avoids colorant 107 leaching during a subsequent process, which serves a dual purpose of sealing anodic film 102 and removing leachable nickel. In this embodiment, the initial level of leachable nickel is lower, and correspondingly lower levels of leachable nickel are ultimately obtained, whilst the overall sealing process still benefits from the very high efficiency of a nickel acetate seal for fixing a specific color.

Anodic film 102 will generally not crack or craze despite exposure to these high temperatures because part 100 and anodic film 102 are immersed in solution 406 rather than in vacuum, air or steam environment. It is possible that anodic film 102 is more flexible and compliant while immersed within solution 406, thereby making anodic film 102 less prone to cracking during the thermal process. If solution 406 is an aqueous solution, it is possible that in such a hydrating environment that solution 406 is helping to reseal any cracking that is occurring within anodic film 102 due to thermal stress. Regardless of the reason, anodic film 102 does not generally experience substantial cracking or crazing, despite conventional knowledge.

Figure 5:
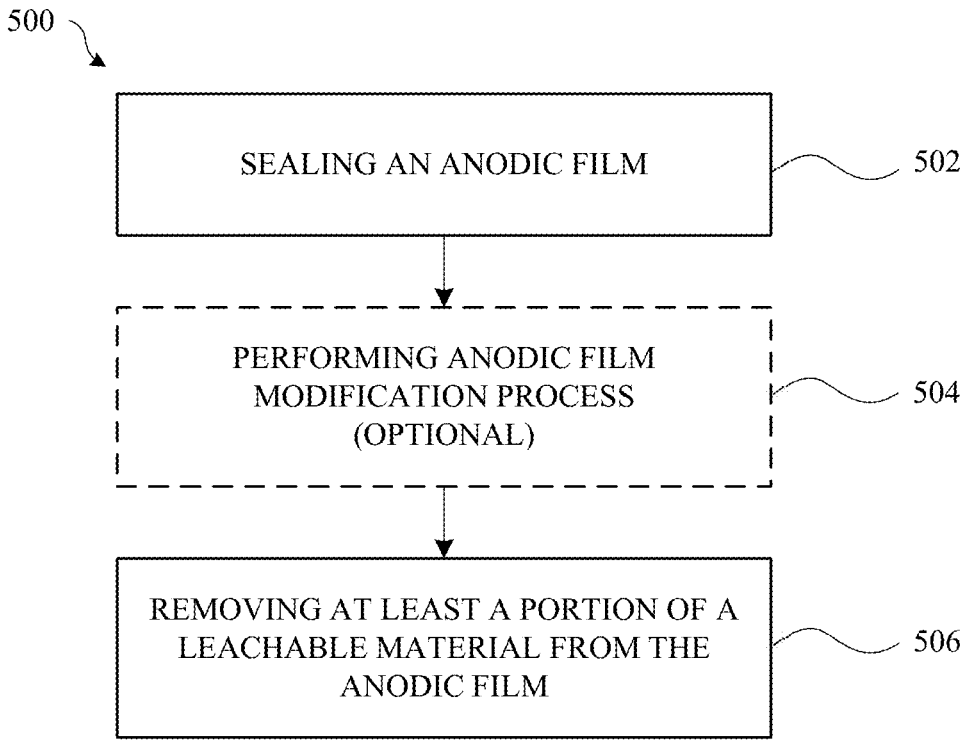
FIG. 5 shows a flowchart indicating a post-sealing thermal process for removing leachable nickel.

FIG. 5 shows flowchart 500 indicating a post-sealing thermal process for removing at least some of a leachable material, such as leachable nickel, within a sealed anodic film, in accordance with some embodiments. At 502, an anodic film is sealed using an anodic film sealing process. In some embodiments, the sealing process includes using a nickel containing sealing solution. In particular embodiments, the sealing solution includes a nickel salt, such as nickel acetate, which can improve the sealing of anodic pores within the anodic film and decrease the time period for anodic pore sealing, and especially reduce the time taken to provide an adequate block at the pore openings, such that colorants are retained during subsequent sealing. In some embodiments, the anodic film is an aluminum oxide anodic film as part of an aluminum alloy part. In some embodiments, the anodic film has colorant infused within its anodic pores prior to sealing. In other embodiments, the anodic film is not colored. After sealing, the anodic film can be optionally rinsed using, for example, a warm water rinse, to remove residues (e.g., smut) or facilitate a drying process.

At 504, an anodic film modification process is optionally performed. The anodic film modification process can include one or more processes to create a desired cosmetic effect or provide a functional purpose. For example, a laser marking process can be used to form markings on or within the anodic film. Alternatively or additionally, a polishing, lapping and/or buffing process can be used to polish an exposed surface of the anodic film to impart a shiny appearance to the anodic film. In some cases, the anodic film modification process can damage the anodic film to some degree. For example, lapping, buffing and polishing operations affect an exposed top surface of an anodic film, and therefor may negatively affect the quality of the sealed pores. Laser marking can introduce localized defects, such as microcracks (cracks in the scale of micrometers in length), within the structure of the anodic film.

At 506, at least a portion of a leachable material within the anodic film is removed using a post-seal thermal process. In some embodiments, the leachable material is nickel that has been infused within the anodic film during, for example, the sealing process 502. In some embodiments, the leachable material is a different material incorporated into the anodic film during the sealing process 502, such as metal acetates or chromates. In some embodiments, the leachable material is one or more of a sulfate, an oxalate and other anions incorporated during a previously performed anodizing process. For example, a sulfate can originate from a sulfuric acid electrolyte and an oxalate can originate from an oxalic acid electrolyte in an anodizing process. In some embodiments, the leachable material is a metal pigment and/or a metal oxide dye compound infused within anodic pores during an anodic film coloring process. In some embodiments, the leachable material includes more than one of the above types of leachable materials.

In some embodiments, the leachable material removal process involves immersing the anodic film in a hot aqueous solution. The temperature of the hot aqueous solution and the time period for performing the post-seal thermal process can be chosen such that the anodic film attains a target leachable material leach rate or less. In some embodiments, the anodic film is immersed in an aqueous solution having temperature of at least 80 degrees Celsius for at least 20 minutes. In some embodiments where the leachable material includes nickel, the target nickel leach rate is about 0.06 micrograms per square centimeter per week or less. In some embodiments, the temperature of the post-seal thermal process is high enough to repair damage within the anodic structure of the anodic film. The damage can be in the form of localized cracks created during the anodic film modification at 504.

Figure 6:
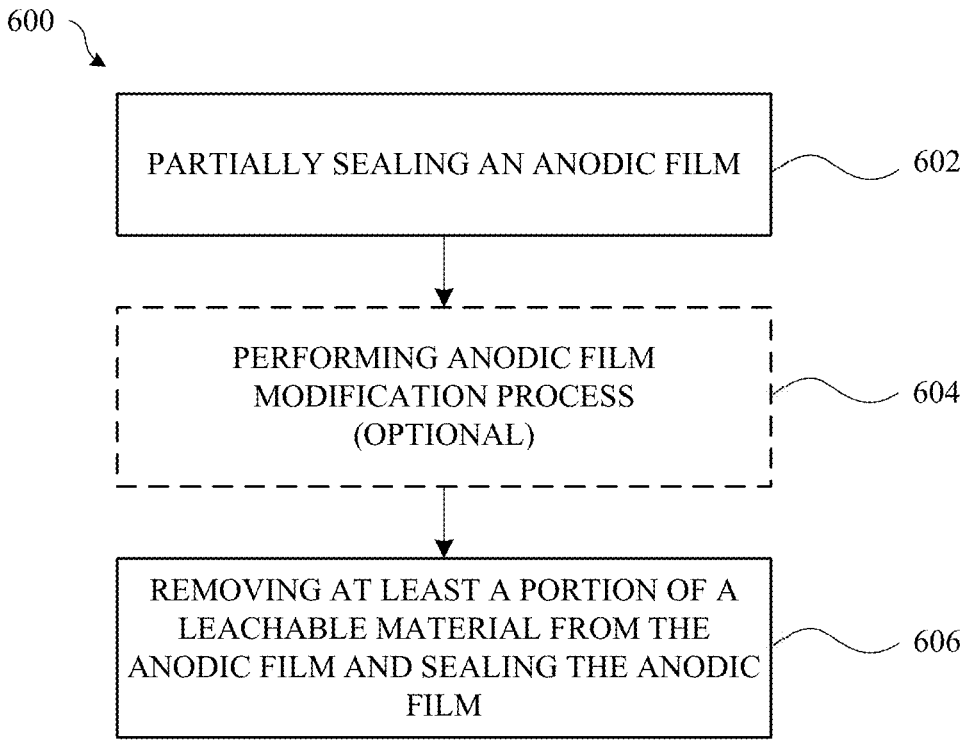
FIG. 6 shows a flowchart indicating a post-sealing thermal process for completing a sealing process and removing leachable nickel.

In some embodiments, the post-seal thermal process is also used to seal a partially sealed anodic film. FIG. 6 shows flowchart 600 indicating such a process. At 602, an anodic film is partially sealed using an anodic pore sealing process, such as a nickel acetate sealing process. In contrast to a sealing process where the anodic film is completely sealed, a partial sealing process involves only partially sealing the pores of the anodic film. This can involve exposing the anodic film to the sealing solution for a shorter amount of time than typical sealing processes—as little as one minute or less (well below a typical time of 1-2 minutes per micrometer of anodic oxide film thickness). In some embodiments, the primary purpose of the partial sealing process is to seal or plug the anodic pores well enough to minimize leaching out of colorant during subsequent processing. In particular embodiments where a nickel acetate sealing process is used, the partial sealing is accomplished in one minute or less.

At 604, an anodic film modification process is optionally performed, such as one or more of the laser marking, polishing, lapping and/or buffing process described above. The initial sealing process 602 can serve primarily to block the pore openings of the anodic from and prevent the leaching of colorant during the anodic film modification process 604.

At 606, at least a portion of the leachable material is removed from the anodic film and the sealing process is completed. That is, the post-sealing process can simultaneously remove some of the leachable material from the anodic film and complete the hydrothermal sealing process 602. In some embodiments where the leachable material includes nickel from an nickel acetate sealing process, this post-seal process involve immersing the anodic film in an aqueous solution at temperatures of 95 degree Celsius or more for about 2 minutes per micrometer of anodic film thickness.

Figure 7:
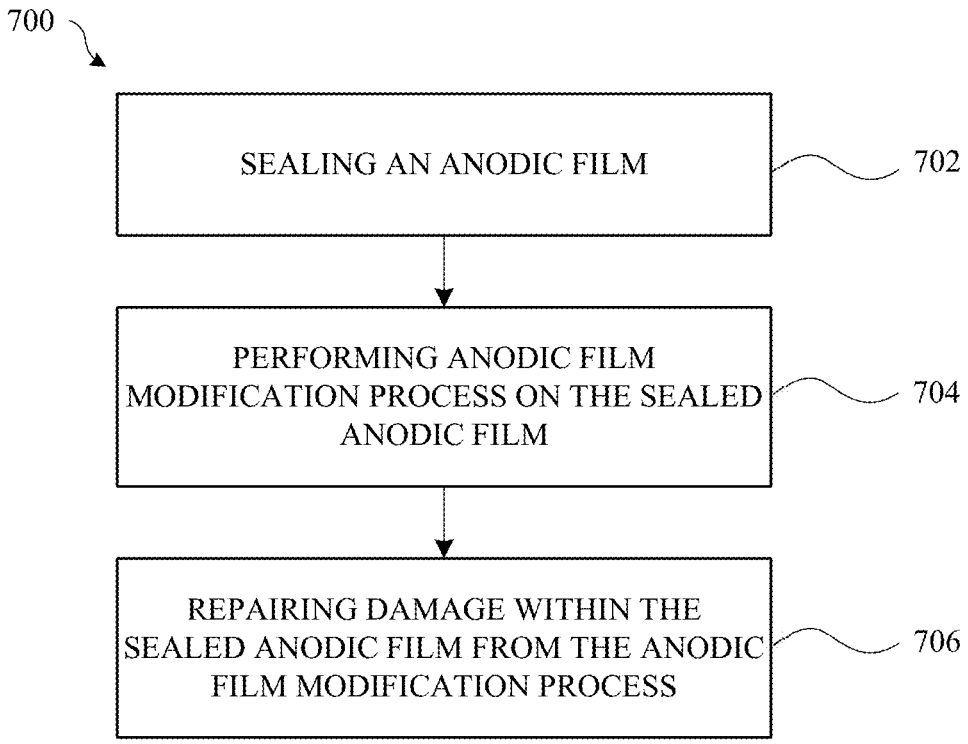
FIG. 7 shows a flowchart indicating a post-sealing thermal process for repairing structural damage within the sealed anodic film.

In some embodiments, repair of localized damage is of primary concern rather than a secondary concern. FIG. 7 shows flowchart 700 indicating a post-sealing thermal process for repairing structural damage within a sealed anodic film, in accordance with some embodiments. At 702, the anodic film is sealed using a sealing process. The sealing process can be a water based sealing process, or one that includes a catalyst such as nickel acetate or chromate.

At 704, an anodic film modification process is performed on the sealed anodic film. As described above, the anodic film modification process can include a laser marking and/or surface finishing process, which can cause localized defects to form within the anodic film. At 706, at least some of the damage formed within the sealed anodic film is repaired using a post-sealing thermal process. As described above, the temperature of the solution used for repairing structural defects may at or near the temperatures used for hydrothermal sealing, which can be higher than would be required for removing nickel or other constituents from the sealed anodic film. The flowchart of FIG. 7. illustrates that in some cases the primary purpose of the post-sealing thermal process is to repair localized damage within the sealed anodic film rather than removal of nickel.

Figure 8:
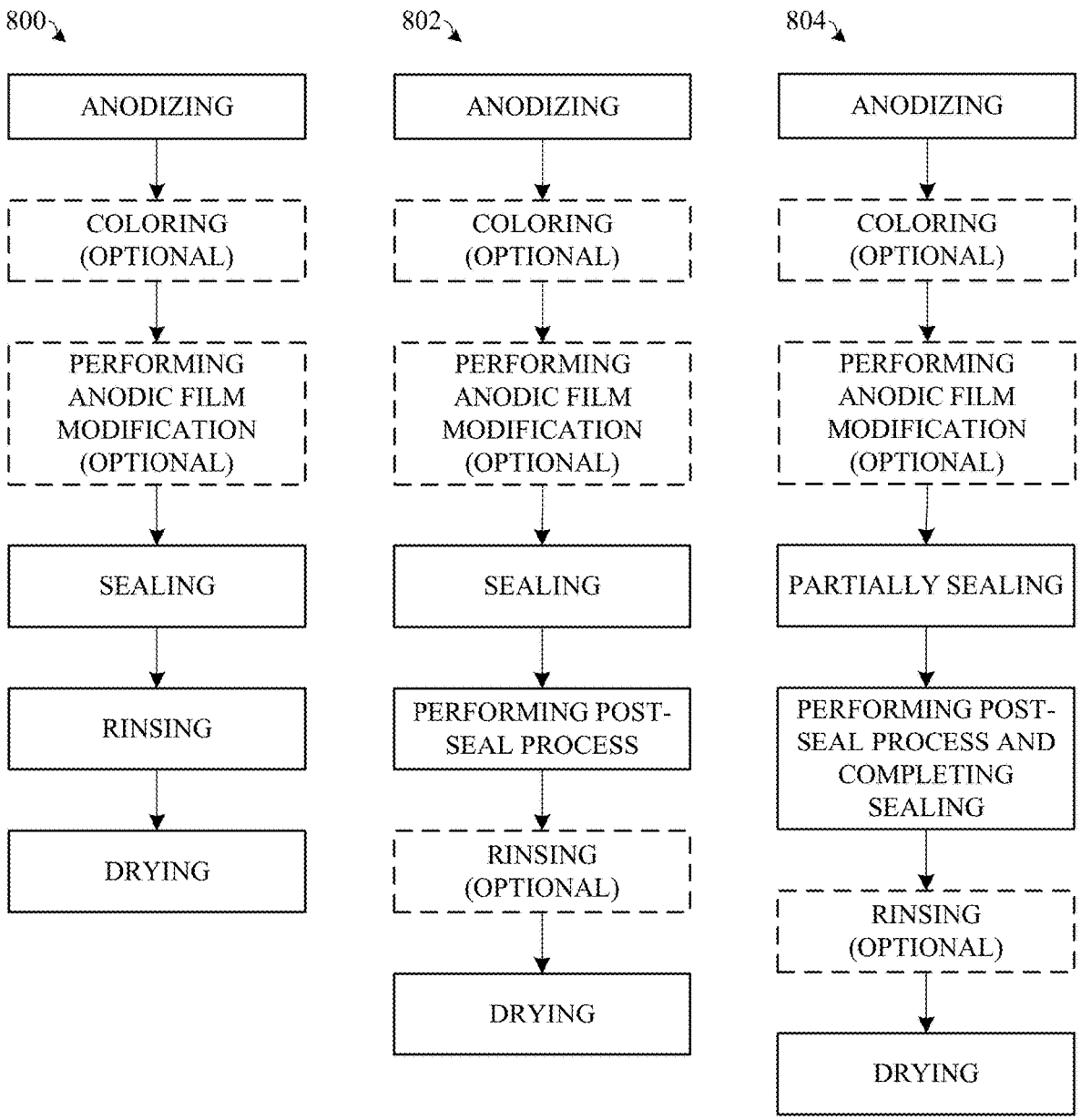
FIG. 8 shows three flowcharts comparing different types of anodic film treatment processes.

FIG. 8 shows flowcharts 800, 802 and 804 comparing different types of anodic film treatment processes. Flowchart 800 indicates a conventional anodic film treatment process and flowcharts 802 and 804 indicate two different anodic film treatment processes that involve post-seal thermal processes in accordance with some embodiments. As shown, conventional process flowchart 800 involves anodizing a substrate to form an anodic film, optionally coloring the anodic film, optionally performing an anodic film modification process, sealing the anodic film, rinsing the anodic film, and then drying the anodic film. If a nickel acetate sealing process is used, the sealing solution typically has a temperature of 85 to 95 degrees Celsius. If a hot water sealing solution is used, the sealing solution typically has a temperature of above 95 degrees C. The anodic film is typically immersed in the sealing solution for about 2 minutes per micrometer of anodic film thickness. The rinsing can be used to remove smut residues. In some cases, the rinsing involves exposing the anodic film to deionized water having a temperature of about 50 to 60 degrees C. for only about 3 minutes to facilitate subsequent drying.

Unlike conventional process flowchart 800, flowcharts 802 and 804 each include performing a post-seal thermal process after the sealing process. The post-seal thermal process can include heating the anodic film to temperatures of about 80 degrees Celsius, 90 degree Celsius, or higher, which is counter to conventional anodic film treatment and practice. The post-seal thermal process can include immersing the anodic film in an aqueous solution at these temperatures until most of a leachable material, such as nickel, is removed from the anodic film, which in some cases can take 15 minutes, 20 minutes, or more. The post-sealing thermal processes of 802 and 804 can also repair some or all of any damage within the anodic film induced by the anodic film modification process, which can include cracks or other local physical damage from laser marking or polishing operations.

The process of flowchart 802 includes completely sealing the anodic film prior to the post-sealing thermal process is performed. The process of flowchart 804 includes only partially sealing the anodic film prior to the post-sealing thermal process, then completing the sealing process simultaneously with removing a portion of the leachable material. In this way, the post-sealing thermal process in flowchart 804 further seals the anodic film and also reduces the level of leachable material that can be leached from the anodic film. Since the post-sealing thermal process completes the sealing, the time for the partial sealing process can be shortened. For example, a partial a nickel acetate sealing process can be accomplished in one minute or less, compared to a 1-2 minute per micrometer of anodic oxide thickness used for more traditional sealing under the same conditions. Flowcharts 802 and 804 each include an optional rinsing process to remove residues and a drying process.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A method of providing a sealed anodized coating, the method comprising:

heating the sealed anodized coating while immersed in a solution to a temperature that causes leachable material to diffuse from a sealant of the sealed anodized coating into the solution so that subsequent to the heating, the leachable material diffuses out of the sealant at no more than an in-service leach rate, the leachable material comprising at least one of nickel, oxalate, sulfate or a metal-based pigment.

2. The method of claim 1, wherein the sealed anodized coating includes pores, and the sealant fills the pores.

3. The method of claim 1, wherein, subsequent to immersing the sealed anodized coating in the solution, the pores are filled with the sealant.

4. The method of claim 1, wherein, subsequent to immersing the sealed anodized coating in the solution, the pores of the sealed anodized coating remain filled with the sealant.

5. The method of claim 1, wherein the sealed anodized coating has a microstructure, and the microstructure is maintained subsequent to immersing the sealed anodized coating in the solution.

6. The method of claim 1, further comprising:

prior to immersing the sealed anodized coating in the solution, exposing the sealed anodized coating to a modification process that causes cracks within the sealed anodized coating, wherein immersing the sealed anodized coating in the solution is sufficient to minimize at least some of the cracks.

7. The method of claim 6, wherein, prior to immersing the sealed anodized coating in the solution, the sealed anodized coating includes between 1 wt % to 3 wt % of the leachable material.

8. The method of claim 1, wherein the leachable material is characterized as having a first diffusion rate, and the sealant is characterized as having a second diffusion rate different than the first diffusion rate.

9. A method of removing a leachable material from a sealed anodized coating, the leachable material comprising at least one of nickel, oxalate, a sulfate, or a metal-based pigment, the method comprising:

exposing the sealed anodized coating to a heated solution such as to cause diffusion of the leachable material from a sealant of the sealed anodized coating and into the heated solution at a target leach rate.

10. The method of claim 9, wherein, prior to exposing the sealed anodized coating to the heated solution, pores of the sealed anodized coating are partially sealed with the sealant, and subsequent to exposing the sealed anodized coating to the heated solution, the pores are completely sealed with the sealant.

11. The method of claim 10, further comprising:

prior to exposing the sealed anodized coating to the heated solution, forming the sealed anodized coating by exposing an anodized coating to a nickel acetate sealing solution.

12. The method of claim 11, wherein the sealant includes nickel that is derived from the nickel acetate sealing solution.

13. The method of claim 10 wherein, subsequent to exposing the sealed anodized coating to the heated solution, a remaining amount of the leachable material included within the pores of the sealed anodized coating corresponds to an in-service leach rate.

14. A method of treating a sealed anodized coating, the sealed anodized coating having pores that are filled with a leachable material that comprises at least one of nickel, oxalate, sulfate or a metal-based pigment, the method comprising:

exposing the sealed anodized coating to a modification process such as to cause crazing of the sealed anodized coating; and repairing the crazing of the sealed anodized coating by exposing the sealed anodized coating to a heated solution such as to cause an amount of the leachable material to diffuse from the sealed anodized coating into the heated solution at a target leach rate.

15. The method of claim 14, wherein the modification process comprises at least one of a laser marking process or a surface finishing process.

16. The method of claim 14, wherein a temperature of the heated solution is 80 degrees Celsius or higher.

17. The method of claim 14, wherein the pores are filled with a sealant, and the leachable material is included in the sealant.

18. The method of claim 17, wherein the leachable material and the sealant have different diffusion rates.

19. The method of claim 9, wherein the sealed anodized coating includes between 1 wt % to 3 wt % of the leachable material.

20. The method of claim 14, wherein, subsequent to repairing the crazing, a remaining amount of the leachable material included within the pores corresponds to an in-service leach rate.

* * * * *